US006880823B2

(12) United States Patent
Itoh et al.

(10) Patent No.: US 6,880,823 B2
(45) Date of Patent: Apr. 19, 2005

(54) SHEET COLLECTION APPARATUS

(75) Inventors: Shinichi Itoh, Kanagawa-ken (JP); Naruaki Hiramitsu, Kanagawa-ken (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 0 days.

(21) Appl. No.: 10/411,191

(22) Filed: Apr. 11, 2003

(65) Prior Publication Data

US 2003/0193131 A1 Oct. 16, 2003

(30) Foreign Application Priority Data

Apr. 12, 2002 (JP) ..... P2002-110853
May 1, 2002 (JP) ..... P2002-129997

(51) Int. Cl.[7] ..... B65H 3/20
(52) U.S. Cl. ..... 271/220; 271/224; 271/202
(58) Field of Search ..... 271/220, 224, 271/202

(56) References Cited

U.S. PATENT DOCUMENTS 5,205,548 A * 4/1993 Yamada et al. ..... 271/3.2
5,332,210 A * 7/1994 Silverberg et al. ..... 271/220
5,810,551 A * 9/1998 Yamanaka ..... 414/790.7

* cited by examiner

*Primary Examiner*—Donald P Walsh
*Assistant Examiner*—Kenneth W Bower
(74) *Attorney, Agent, or Firm*—Pillsbury Winthrop LLP

(57) ABSTRACT

A sheet collection apparatus has a stacking portion to stack mails in the standing position, a back-up plate in contact with one end of stacked mails in the stacked direction, and take-in rollers arranged at the positions contacting the other end of stacked mails. The take-in rollers are rotated at a slower peripheral speed than the conveying speed of mails taken in the stacking portion.

24 Claims, 8 Drawing Sheets

| | LENGTH (mm) | 140 | 140 | 140 | 200 | 200 | 200 | 230 | 230 | 230 | 260 | 260 |
|---|---|---|---|---|---|---|---|---|---|---|---|---|
| | STIFF-NESS(mN) | 1500 | 800 | 200 | 1500 | 800 | 200 | 1500 | 800 | 200 | 1000 | 800 |
| 3.8m/s | JAM | None | None | None | None | None | None | None | None | None | None | None |
| | SKEW | None | None | Small | None | None | None | None | Small | Small | None | None |
| 3.3m/s | JAM | None | None | None | None | None | None | None | None | None | None | None |
| | SKEW | None | None | Small | None | None | None | None | Small | Small | None | None |

FIG. 7

SHEET COLLECTION APPARATUS

BACKGROUND OF THE INVENTION

1. Field of the Invention

The present invention relates to a sheet collection apparatus which stacks and houses conveyed sheets.

2. Description of Related Art

As a sheet collection apparatus, for example, a mail collection apparatus which stacks and houses mails conveyed at a relatively high speed in the erected posture is so far known.

This type of mail collection apparatus has a stacking portion, a take-in roller to take in mails that are conveyed to the stacking portion, and a back-up plate to bias mails stacked in the stacking portion in the stacking direction and press mails against the take-in roller.

The stacking portion has a bottom wall to support the lower elongate edges of mails conveyed on the conveying path and pushed in the stacking portion by the take-in roller and a rear wall against which the leading edge of a mail in the conveying direction runs and is stopped there.

A succeeding mail that is conveyed at a high speed is taken in the contact portion between mails at the end of mail away from the back-up plate. When the take-in roller is rotated, the mail is further taken in and the leading edge of the mail runs against the rear wall and is stopped there. Plural mails are thus stacked sequentially in the stacking portion.

However, in the above-mentioned conventional sheet collection apparatus, as the rotating speed of the take-in roller is set at the same speed as the mail conveying speed, the leading edge of mail taken in the stacking portion runs against the rear wall while maintaining a high-speed and the mail was bounced by the shock when the rear wall. As a result, the stacking posture of mails became uneven and a noise problem was caused.

Further, in the above-stated conventional sheet collection apparatus, mails stacked at the end in the conveying direction in the stacking portion are in contact with the take-in roller that is constantly in rotation. Therefore, when the take-in roller is rotated at a high-speed as stated above, there was such a problem that a mail was contaminated on its surface by the friction between the roller surface and the mail surface.

Further, in the case of the conventional sheet collection apparatus, when stacked mails in the stacking portion exceeds a fixed quantity, mass of mails itself becomes a large load, the thrusting force between a mail at the end and the take-in roller becomes large and the take in operation by the take-in roller couldn't carried out properly and the jamming was generated.

Further, in a conventional postal matter collection apparatus, there is provided a guide plate inclined to already stacked mails to guide mails that are conveyed on the conveying path to the contacting portion between already stacked mails and the take in roller.

Mails conveyed on the conveying path are guided along the inclined guide plate and sent to the contacting portion between the take in roller and already stacked mails. Then, these mails are taken in the stacking portion by the rotating take-in roller along the already stacked mails and the rear end of the mails are bumped against the wall and stopped there. In order to orderly stack mails that are taken in next, the guide plate is provided to incline to the mails at the end portion.

However, in the case of such type of apparatus to guide mails along the guide plate provided inclining to the stacked mails at the end portion as the above-mentioned conventional mail collection apparatus, the state of mail changes depending on stiffness of mail being guided. That is, the rear edge of a mail having a relatively large stiffness is properly separated from the guide plate by a large stiffness. But, the rear edge of a mail having a small stiffness is kept attached to the guide plate even when taken in by the take-in roller and a mail that is taken in next could not be stacked orderly and jamming was caused.

SUMMARY OF THE INVENTION

An object of the present invention is to provide a sheet collection apparatus capable of stacking sheets in the certain and stable postures.

Further, an object of the present invention is to provide a sheet collection apparatus capable of stacking all sheets surely regardless of stiffness of sheets.

According to the present invention, there is provided a sheet collection apparatus to handle first, second and third sheets conveyed in order at a first speed. The apparatus comprises a bumping wall which an edge of the sheets bumps and which stops the sheets; a stacking portion to collect the sheets stopped by the bumping wall; a biasing member to compressively contact a surface of the first sheet collected in the stacking portion; a take-in roller provided opposite to the biasing member, wherein the take-in roller rotates at a second speed that is lower than the first speed of the third sheet, sends the third sheet to the stacking portion along the second sheet already collected in the stacking portion, and makes the edge of the third sheet bump the bumping wall.

Further, according to the present invention, there is provided a sheet collection apparatus to handle first, second and third sheets conveyed in order at a first speed. The apparatus comprises a bumping wall which an edge of the sheets bumps and which stops the sheets; a stacking portion to collect the sheets stopped by the bumping wall; a biasing member to compressively contact a surface of the first sheet collected in the stacking portion; and a take-in roller provided opposite to the biasing member, wherein the take-in roller rotates at a second speed to reduce gradually a speed of the third sheet, contacts and sends the third sheet to the stacking portion along the second sheet already collected in the stacking portion, and makes the edge of the third sheet bump the bumping wall.

Further, according to the present invention, there is provided a sheet collection apparatus to handle first, second and third sheets conveyed in a standing position in order. The apparatus comprises a bumping wall which an edge of the sheets bumps and which stop the sheets; a stacking portion including a substantially horizontal bottom plate to receive a lower edge of the sheets stopped by the bumping wall; a biasing member to compressively contact a surface of the first sheet received by the stacking portion; a take-in roller provided opposite to the biasing member, wherein the take-in roller contacts and sends the third sheet to the stacking portion along the second sheet already collected in the stacking portion, and makes the edge of the third sheet bump the bumping wall; and a moving mechanism to move the lower edge of the sheets to first and second directions which are opposite to each other.

Further, according to the present invention, there is provided a sheet collection apparatus to handle first, second and third sheets conveyed in order. The apparatus comprises a bumping wall which an edge of the sheets bumps and which stops the sheets; a stacking portion to collect the sheets stopped by the bumping wall; a biasing member to compressively contact a surface of the first sheet collected in the stacking portion; a take-in roller provided opposite to the biasing member, wherein the take-in roller sends the third sheet to the stacking portion along the second sheet already collected in the stacking portion, and makes the edge of the third sheet bump the bumping wall; a guide plate to guide the third sheet between the take-in roller and the second sheet already collected in the stacking portion; and a separating portion to separate the third sheet guided along the guide plate from the guide plate.

BRIEF DESCRIPTION OF THE DRAWINGS

FIG. 7 is a table showing the state of mails collected by changing a parameter in the mail collection apparatus shown in FIG. 7;

DETAILED DESCRIPTION OF A PREFERRED EMBODIMENT OF THE INVENTION

A preferred embodiment of the present invention will be explained below in detail referring to the attached drawings.

Figure 1:
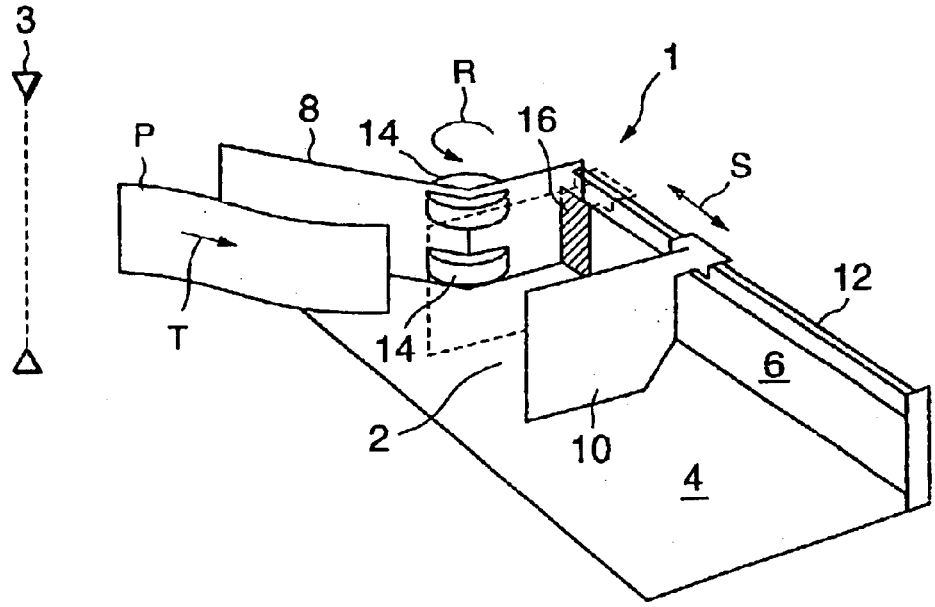
FIG. 1 is a schematic perspective view showing an outer view of a mail collection apparatus as one embodiment of the sheet collection apparatus of the present invention.

FIG. 1 shows the outline of the structure of a mail collection apparatus 1 (hereinafter, called simply as a sheet collection apparatus 1) to house mails P (sheets) conveyed in the standing position at a relatively high-speed by stacking in the surface direction.

The sheet collection apparatus 1 has a stacking portion 2 to accept mails P conveyed at a fixed speed V (a first speed) in the arrow direction T shown in the diagram by way of a conveying path (not shown). In this embodiment the conveying speed V of mails P toward the stacking portion 2 was set at 3.8 [m/sec]. Mails P are taken into the stacking portion in the standing position with the longer sides along the conveying direction T. At this time, the passage of mails P is detected by a timing sensor 3 provided at a prescribed position on the conveying path in front of the stacking portion 2.

The stacking portion 2 has a bottom wall 4 to support a mail P when taking it in the stacking portion 2 by way of the conveying path by bringing the lower side, that is, one of the long sides of mail P brought in contact with the bottom wall. Further, the stacking portion 2 has a rear wall 6 (a bumping wall) to stop a mail by running the leading edge of mail P in the conveying direction, that is, one of the short edges against thereto. In addition, the stacking portion 2 has a guide plate 8 to guide a mail P conveyed through the conveying path toward the rear wall 6. The guide plate 8 is formed with an approximately rectangular shaped plate of which middle portion is slightly bent.

On the upper end side of the rear wall separated from the bottom wall 4 of the rear wall 6, a rail 12 with a back-up plate 10 (a biasing member) installed slidably in the arrow direction S (the stacking direction). The rail 12 is extended along the stacking direction of mails P (the fist and second directions).

The back-up plate 10 is slid in the arrow direction S by a sliding mechanism (not shown) according to a stacking volume of mails P stacked in the standing position in the stacking portion. Further, the back-up plate 10 is biased in the stacking direction in the state contacting the face of a mail (a first sheet) at one end in the stacking direction at a fixed pressure by a biasing means such as a spring and the like (not shown).

Two take-in rollers 14 provided on the same axis and separated to the upper and lower parts are installed to the bent middle portion of the guide plate 8. That is, the take-in rollers 14 are provided on the bottom wall 4 at the positions to clamp a mail P stacked in the standing position between the back-up plate 10. In other words, the take-in rollers 14 are provided at the positions to bring the outer surfaces in contact with a mail (a second sheet) at the other end in the stacking direction. Then, the take-in rollers 14 rotate in the arrow direction R shown in FIG. 1 along the conveying direction T of the mail P at a fixed peripheral speed Vr (a second speed) that is slower than the conveying speed V.

The take-in rollers 14 are provided at positions away from the rear wall 6 by a distance at least shorter than the shortest length L min of the mail along the conveying direction of the mail handled by the sheet collection apparatus. In this embodiment, the take-in rollers 14 are arranged so that a distance Lw from the position of the outer surfaces to contact the rear wall 6 becomes 6.0 [mm].

Further, at the position where the leading edge of a mail P taken in the stacking portion 2 by the take-in rollers 14 is brought in contact with the rear wall 6, a vibration absorption gel 16 is pasted as a shock absorption member to absorb a shock when the leading edge of a mail P runs against the rear wall 6. For the vibration absorption gel 16, for example, a silicon shock absorption member is available. This material is made in a thin film and pasted to a prescribed position of the rear wall 6.

A mail P (a third sheet) conveyed on the conveying path is guided along the guide plate 8 at the speed V and is fed between the face of a mail P in contact with the other ends of the take-in rollers 14 and the peripheral surfaces of the taken in rollers 14. At this time, the take-in rollers rotating at a peripheral speed Vr slower than the conveying speed V of mail P contacts the mail P and the mail P is further taken into the stacking portion 2 by the rotation of the taken in rollers 14 along the mail P at the edge. Then, the edge of the mail P runs against the vibration absorption gel 16 on the rear wall 6 and stops there.

Thus, plural mails P conveyed successively are taken in the stacking portion 2 and stacked there in the stacked state. At this time, the back-up plate 10 is slid in the arrow direction S according to the stacked volume of mails P by the slide mechanism (not shown).

As described above, according to this embodiment, the take-in rollers 14 are rotated at the peripheral speed Vr slower than the conveying speed V of mails P. Therefore, the speed of mail P can be decelerated at the time when the edge of mail P in the conveying direction runs against the rear wall 6 and a shock generated at the collision can be reduced. Further, the shock absorption effect could be more increased by the vibration absorption gel 16 pasted on the collision point.

As a result, the mail P could be prevented to jump up when the edge of mail P runs against the rear wall 6 and the mail P can be stacked in the stable posture. Thus, as the stacking posture of the mails P is stabilized, no defects can be produced in the process at the latter stage.

Further, as the peripheral speed Vr of the take-in rollers 14 was made slower than the conveying speed of mails P, the effect of friction generated between mails P at the end in the stacking direction and the constantly rotating take-in rollers 14 could be reduced and contamination and fracture produced on the faces of mails could be prevented.

In the sheet collection apparatus 1 of this embodiment, in order to check an optimum peripheral speed Vr of the taken in rollers 14, the stacking state of mails P was observed by conveying prescribed number of sheets of mail at the processing speed 45,000 sheets/hour in the stacking portion 2 (the conveying speed V=3.8 m/sec) and changing the peripheral speed Vr of the take-in rollers 14. As a result of the observation, it was revealed that a satisfactory stacking state is obtained when the peripheral speed Vr of the take-in roller 14 was set at ⅓–⅔ (1.3–2.5 m/sec).

That is, when the peripheral speed Vr of the take-in rollers 14 was made faster than 2.5 m/sec under the above-stated condition, the edge of mail P jumped up when the edge of the mail P run against and the stacked posture became unstable. Further, the shock sound was minimum 72 db irrespective of the vibration absorption gel 16 pasted.

Further, when the peripheral speed Vr of the take-in rollers 14 was set below 1.3 m/sec, mails were stacked not in time and jamming was caused. That is, when the peripheral speed Vr was made below 1.3 m/sec, 46 ms or more time is needed for a mail to run against the rear wall 6 after contacting the take-in rollers 14. A stacking time available is minimum 56 ms at the processing speed 45,000 sheets/hour and when considering a fluctuation in conveying interval, the stacking may not in time.

On the contrary, when the peripheral speed of the take-in rollers 14 was set at 1.3–2.5 m/sec, the edges of all mails P could be aligned to a distance within 5 mm from the rear wall 6 and the stacking posture could be stabilized. In other words, it was revealed that a satisfactory stacking state can be obtained when the peripheral speed Vr of the take-in rollers 14 is set at ⅓–⅔ of the conveying speed V. Further, the shock sound at this time was about 67 db.

Further, the vibration absorption gel 16 was pasted on the real wall 6 in this embodiment; however, a general vibration absorption rubber could be pasted instead of the vibration absorption gel 16 and the shock sound at this time 69 db.

Here, the peripheral speed Vr of the take-in rollers 14 is considered from another angle in the above-stated embodiment.

Assuming that the minimum length of a mail P is Lmin mm and a conveying gap between mails P conveyed at the speed V mm/sec, a minimum time required for stacking one sheet of mail P, that is, a minimum conveying cycle Cmin is:

$$Cmin=(Lmin+G)/V$$

Further, for the normal stacking operation, it is necessary to complete the stacking operation of a preceding mail P before the end of a succeeding mail P in the conveying direction contacts the take-in rollers 14. Therefore, there are restrictions shown below for the peripheral speed Vr of the take-in rollers 14 to take in mails P in the stacking portion 2. Further, a distance from the take-in rollers 14 to the rear wall 6 is Lw.

$$Vr \geqq Lw/Cmin$$

That is, from the peripheral speed Vr of the take-in rollers 14 set at a speed slower than the conveying speed V and the above-stated two formulas, it can be seen that the peripheral speed Vr of the take-in rollers 14 is better to be set at a speed to satisfy:

$$V > Vr \geqq Lw \times V/(Lmin+G)$$

Figure 2:
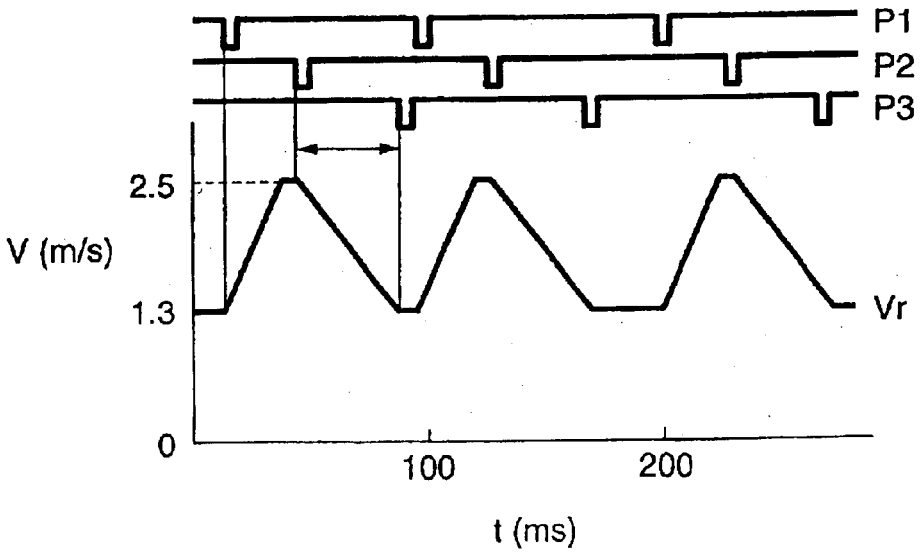
FIG. 2 is a timing chart showing a speed change example of a take-in roller in the embodiment to adjust the speed of the take-in roller of the mail collection apparatus shown in FIG. 2.

Next, an embodiment when the peripheral speed Vr of the take-in rollers 14 was changed as shown in FIG. 2 in the above-stated sheet collection apparatus 1 will be explained. Here, the peripheral speed of the take-in rollers 14 was adjusted within a prescribed range of speed whenever a mail P is taken in the stacking portion 2. Further, as a driving means to rotate the take-in rollers 14, a stepping motor (not shown) was used. When a stepping motor is used, it is possible adjust the peripheral speed of the take-in rollers 14 easily by giving driving pulses to be input to a motor driver while changing the driving pulses.

In the graph shown in FIG. 2, peripheral speed of the take-in rollers 14 is shown on the vertical axis and elapsed time t [ms] is shown on the horizontal axis. Further, the timing of the leading edge of mail P successively conveyed to pass the timing sensor 3 is shown by P1, the timing of the end of mail P to contact the take-in rollers 14 is shown by P2, and the timing of the leading edge of mail P to run against the rear wall 6 is shown by P3.

First, in the waiting state before a mail P is conveyed, the take-in rollers 14 are rotating at a speed Vr=1.3 m/sec. Then, when a mail P is conveyed at the conveying speed V=3.8 m/sec and its leading edge passed the timing sensor 3, the rotary speed Vr of the take-in rollers 14 is accelerated to 2.5 m/sec from 1.3 m/sec. The accelerated speed at this time is so set that the peripheral speed of the take-in rollers 14 is increased to 2.5 m/sec when the leading edge of a mail P contacts the take-in rollers 14.

Then, from the point of time when the leading edge of a mail P contacts the take-in rollers 14, the deceleration of the take-in rollers 14 starts. That is, the take-in rollers 14 are rotated so that the speed is gradually decelerated while kept in contact with the surface of the mail P and the take in speed of the mail P is decelerated slowly. The deceleration speed at this time is so set that the peripheral speed of the take-in rollers 14 is returned to 1.3 m/sec when the leading edge of a mail P runs against the rear wall 6. In other words, when the end of a mail P runs against the rear wall 6, the speed of the mail P is sufficiently decelerated.

Then, a series of acceleration/deceleration described above are repeated for every mail P and plural mails P conveyed successively are stacked sequentially in the stacking portion 2 while they are decelerated. That is, it is also possible to sufficiently reduce a shock as well as a shock sound sufficiently when mails P run against the rear wall and stabilize the stacking posture of mails P in this embodiment.

Further, in this embodiment, a shock sound when mails P run against the rear wall 6 could be reduced to 66 db. In addition, by increasing the accelerating speed of the take-in rollers 14 larger than the decelerating speed, it is made possible to cope with the shortest stacking cycle Cmin [s]=80 ms when the processing speed of mails P is 45,000 sheets/hour.

Further, in this embodiment, while a succeeding mail P arrives at the timing sensor 3 after the leading edge of a preceding mail P runs against the rear wall 6, the peripheral speed of the take-in rollers 14 is maintained at 1.3 m/sec. However, if relatively much time is available before a succeeding mail P arrives, the take-in rollers 14 may be once stopped. Thus, the possibility for generating soil or break of already stacked mails by the friction with the rotating take-in rollers 14 can be reduced by stopping the take-in roller 14 during the stacking operation of mails P.

Here, the behavior of the take-in rollers 14 in the above-stated embodiment is observed from another angle of view.

That is, when assuming that the minimum cycle to convey mails P at the conveying speed V mm/sec is Cmin s, the minimum length of mails P treated in the sheet collection apparatus 1 is Lmin mm, and a gap between mails P conveyed at the speed V mm/sec is G mm, the peripheral speed Vr mm/sec of the take-in rollers 14 is required to satisfy the following formula:

That is, when two mails P taken in the sheet collection apparatus 1 at the shortest conveying cycle Cmin are considered, it is necessary to complete the stacking $$\int_0^{Cmin} Vr\,dt \geq Lmin + G$$

operation of a succeeding mail P before a succeeding mail P contacts the taken in roller 14. Therefore, the volume of mails P taken by the take-in rollers 14 into the stacking portion 2 in the minimum conveying cycle Cmin must be larger than at least the length of a minimum mail P plus a gap G. In other words, it is enough to adjust the speed of the take-in rollers 14 so that the take in $$\int_O^{Cmin} Vr\,dt$$

volume of mails P by the take-in rollers 14 satisfies the above-mentioned condition.

Next, a deformed example of the sheet collection apparatus in the above embodiment will be explained referring to FIG. 3 and FIG. 4.

A sheet collection apparatus 20 differs from the sheet collection apparatus 1 in the above embodiment in that it has a toothed wheel 22 rotating in the stacking direction of mails P. Therefore, other component elements will be assigned with the same reference numerals and the detailed explanation thereof will be omitted here.

The toothed wheel 22 is provided so that it is partially exposed in the stacking portion 2 through the bottom wall 4. A rotary shaft 22*a* of the toothed wheel 22 is provided at a position away 100 mm from the guide plate below the bottom wall 4 (See FIG. 4). The toothed wheel 22 has plural cogs 22*b* on its periphery and bottoms 22*c* between the adjacent cogs are capable of rotating in the forward and backward directions at a speed to move 75 mm/sec in the stacking direction.

That is, the toothed wheel 22 functions to move the lower edges of mails P stacked in the stacking portion 2 by putting them in the bottoms 22*c* of the roller portions exposed in the stacking portion and rotating them in both the forward and backward directions. Further, the toothed wheel 22 is rotated with the rotation of mails P moving in the stacking direction when it does not rotate in either direction. In this embodiment, the toothed wheel 22 is controlled to rotate according to a stacked volume of mails P.

Figure 3:
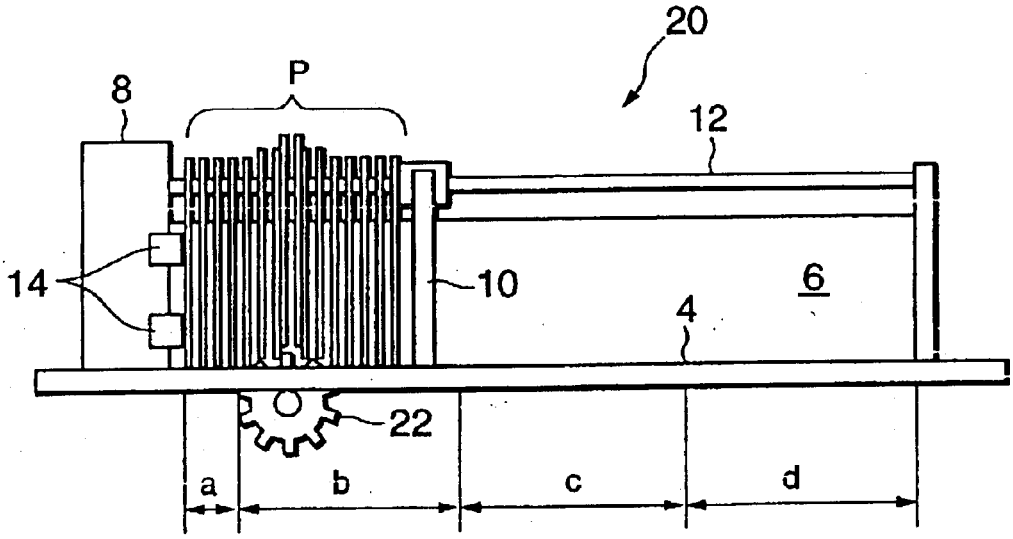
FIG. 3 is a front view of a deformed example of the mail collection apparatus shown in FIG. 1.

When the stacked volume of mails P stacked in the stacking portion 2 is 0–70 mm, that is, mails P are in the area a shown in FIG. 3, they are not reached the toothed wheel 22 and therefore, the toothed wheel is kept in the idler state.

Figure 4:
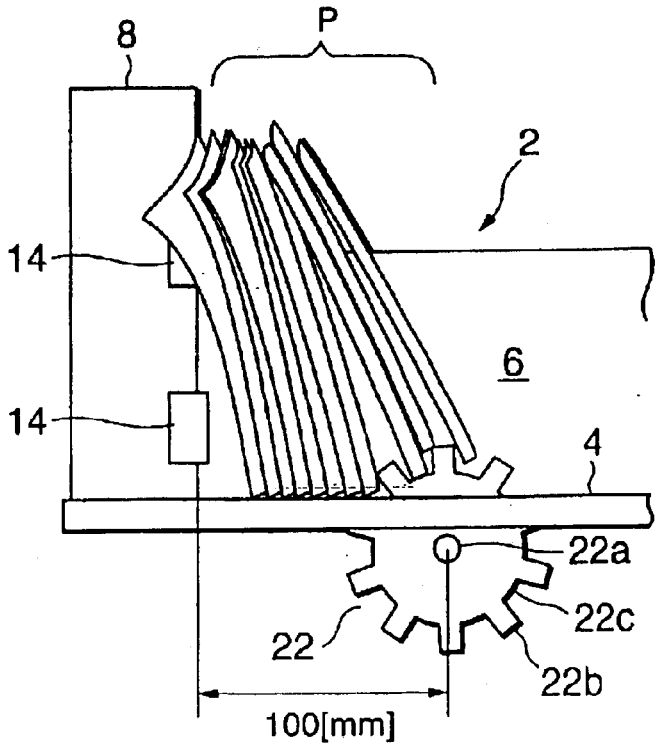
FIG. 4 is an enlarged sectional view of the construction of essential portion of the mail collection apparatus shown in FIG. 3.

When the stacked volume of mails P is 70–200 mm (the area b in FIG. 3), it is expected that several sheets out of stacked mails P act on the toothed wheel 22 and fall down in the direction of the guide plate 8 as shown in FIG. 4. Therefore, when the stacked volume of mails P is in the area b, the toothed wheel 22 is rotated in the direction to the guide plate 8 (the second direction) to move the lower edges of mails P so as to prevent the mails P from falling down. On the contrary, if the toothed wheel 22 is not rotated in the second direction, the fell down mails P (the second sheets) may block the conveying path of mails P and cause the jamming.

When the stacked volume of mails P is 200–350 mm (the area c in FIG. 3), the weight of mail P itself is balanced with the biasing force of the back-up plate 10 and the toothed wheel 22 is put in the idler state and rotated jointly.

When the stacked volume of mails P is 350–540 mm (the maximum stacked volume of this sheet collection apparatus 20 is 540 mm), the weight of the stacked mails P is no longer balanced with the biasing force and the weight of mail P itself becomes a large load. Therefore, the toothed wheel 22 is rotated in the first direction toward the back-up plate 10 so as to reduce the thrust force between mails P at the bottom sides and the take-in roller 14. Thus, even if the stacked volume of mails P exceeded a stipulated value (350 mm in this embodiment), it is possible to maintain the pressed state between mails P at the bottom and the take-in rollers 14 a constant level, continue a satisfactory stacking operation and prevent the jamming.

According to this embodiment as explained above, the bottom side of mails P stacked in the stacking portion 2 are made movable in the stacking direction, therefore, it becomes possible to perform a satisfactory stacking operation any time irrespective of a stacking volume of mails P. Thus, the jamming for defective stacking, generation of excessive friction between mails P at the bottom and the take-in roller 14 and contamination or break of mails P can be prevented.

A second embodiment of the present invention will be explained below in detail referring to the attached drawings.

Figure 5:
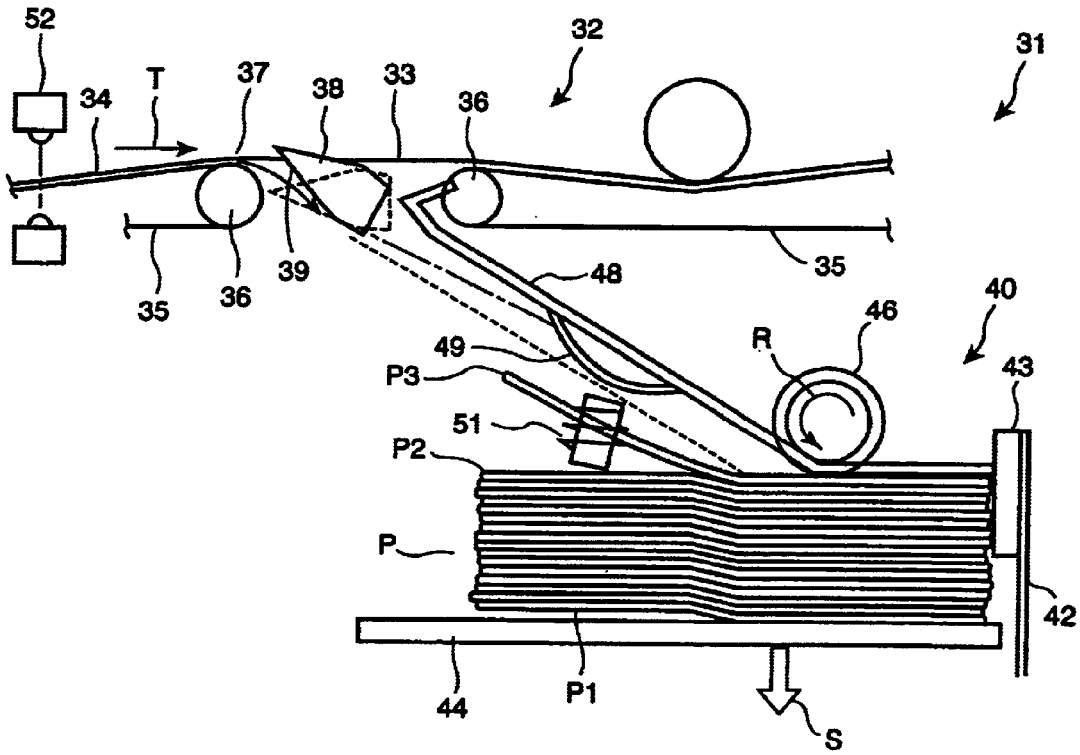
FIG. 5 is a plan view showing a mail collection apparatus as a second embodiment of the present invention.

FIG. 5 is a plan view of a mail collection apparatus 31 (hereinafter, referred to simply as a collection apparatus 31) viewed from the above. This collection apparatus collects and stack mails P (sheets) in the plane direction, which are conveyed in the erected state at a relatively high speed.

The collection apparatus 31 has a conveyer 32 to convey a mail P that is an object of processing at a uniform speed in the arrow direction T shown in FIG. 5. The conveyer 32 has a primary conveying path 34 to convey mails P in the erected posture, an endless conveyer belt 33 that is extended in the arrow direction T at a position that defines one side of the primary conveying path 34, and an endless conveyer belt 35 that is wound round plural rollers 36 and able to run at a position that defines the other side of the primary conveying path 34. That is, mails P are conveyed in the arrow direction T on the primary conveying path 34 in the clamped, restricted and erected state in contact with a guide member of which lower end side is not shown.

At the position of the downstream side in the conveying direction separated in a fixed distance from the end of a nip between a pair of conveyer belts 33 and 35, there is provided a gate 38 (a conveying direction changer)

to selectively switch the conveying direction of mails conveyed on the primary conveying path 34 in two directions. The gate 38 is provided so that it can be switched either to a first position shown by the broken line in FIG. 5 to pass a mail P conveyed on the primary conveying path 34 as-is or a second position shown by the solid line in FIG. 5 to direct a mail P to the collection apparatus described later by bumping the rear end of the mail P against the inclined plane 39 while holding the inclined plane 39 of the gate 38 at a preset angle.

At a position out of the primary conveying path 34, a stacking portion 40 is provided to stack mails P conveyed on the primary conveying path 34 through the gate 38 switched to the second position in the collected state. The stacking portion 40 has a rear wall (a bumping wall) for stopping the conveyed mail P by bumping the rear end of the conveyed mail in the conveying direction. The rear wall 42 is provided along the plane nearly orthogonal to the conveying direction T of a mail P by the primary conveying path 34. On the position of the rear wall 42 wherein he rear end of a mail P in the conveying direction is bumped against, an absorbing gel 43 is pasted for reducing a shock when bumped. A mail taken in next is put over a mail that is bumped against the absorbing gel 43 pasted on the rear wall and stopped sequentially. Thus, plural mails P are orderly collected.

A backup plate 44 (a biasing member) is provided at a position to contact a mail P1 (a first sheet) at one end in the stacking direction out of mails P stacked in the stacking portion 40, that is, a mail P1 (a first sheet) that was first stacked in the stacking portion 40. The backup plate 44 is slid in the arrow direction S in FIG. 5 by a sliding mechanism (not shown) according to the amount of mails P stacked in the stacking portion 40 in the erected posture. Further, the backup plate 44 biases the stacked mails P in the stacking direction (upward in FIG. 5) by a spring (not shown) and other biasing means at a certain pressure.

At the position to contact a mail P2 (a second sheet) at the other end in the stacking direction out of mails P stacked in the stacking portion 40, that is, a mail P2 lastly stacked in the stacking portion 40, there is provided a take-in roller 46 comprising a rubber roller. That is, the take-in roller 46 is provided at a position to clamp a stacked mail P between the backup plate 44 and the take-in roller 46. The take-in roller 46 rotates in the arrow direction R in FIG. 5 along the conveying direction of mails P, clamps a mail P3 (a third sheet) conveyed on the primary conveying path 34 at the contacting portion between the already stacked mail P2 at the end and the take-in roller 46, and takes in the mail P3 toward the rear wall 42.

Between the gate 38 provided on the primary conveying path 34 and the contacting portion of the take-in roller 46, a guide plate 48 is provided to guide the mail P conveyed toward the stacking portion 40 to the contact portion by face contacting it. The guide plate 48 is provided by almost continuously inclined on the inclined plane of the gate 39 that is switched to the second position at a prescribed angle to a second mail P2 at the end of already stacked mails in the stacking portion 40.

At the middle portion of the guide plate 48, there is provided a projecting portion (a separating portion) 49 projecting toward the second sheet P2 stacked in the stacking portion 40. This projecting portion 49 functions to separate the rear end of a mail having a relatively small stiffness in the conveying direction as described later in detail.

At the position adjacent to the rear end of a second mail P2 stacked in the stacking portion 40, a screw 51 (a regulator) is provided to feed the rear end of a third postal sheet that is to be fed next in the direction of the already stacked second postal sheet P2. The screw 51 is in such structure that spiral rotary cog in gradually different diameters are projected on the peripheral surface of a nearly cylindrical rotary shaft. The screw 51 is mounted in a posture that the large diameter side of the rotary cog is close to the rear end side of an already stacked second member P2, the rotary shaft is nearly orthogonal to mails that are fed and the screw 51 is partly exposed in the stacking portion 40 from the bottom wall (not shown) of the stacking portion 40.

Further, the screw 51 is provided at a position away from the rear wall 42, where the length of mails P along the conveying direction is at least shorter than the most shortest length of a mail along the conveying direction. Further, the above-mentioned take-in roller 46 and the screw 51 are driven to rotate independently by an AC motor (not shown).

Figure 6:
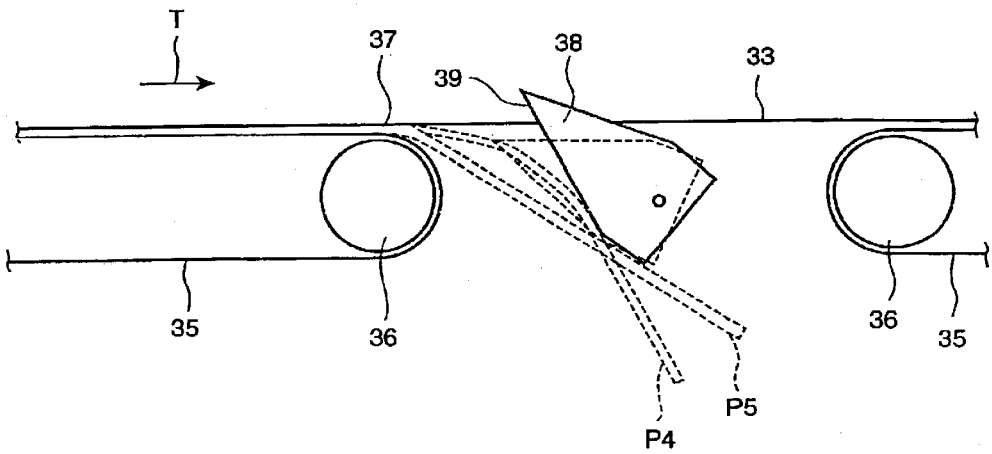
FIG. 6 is a plan view showing an enlarged essential portion for explaining a gate that is used in the mail collection apparatus shown in FIG. 5.

Next, the operation of the above-mentioned collection apparatus 31 will be described referring to FIG. 5 and FIG. 6.

When a mail P assigned for stacking in the collection apparatus is conveyed in the arrow direction T on the primary conveying path 34, the gate 38 is switched to a second position shown by the solid line in the figure triggered by the passage of the rear end P sensed by a timing sensor 52 arranged at the upper stream side of the gate 38.

The mail P conveyed on the primary conveying path 34, its rear end is bumped against the sloped plane 39 of the gate 38 switched to the second position and its conveying direction is switched to the stacking portion 40. At this time, mails P4 and P5 passed through an end of a nip 37 that is formed by a pair of conveyer belts 33 and 35 defining the primary conveying path 34 are kept in the beam state temporarily by the end of the nip 37 until the rear ends are bumped against the inclined plane 39 of the gate 38.

Then, when the rear end of the mail P4 having a relatively large stiffness is bumped against the inclined plane 39, it is folded at a relatively moderate curvature and directed to the stacking portion 40. That is, a mail P having a relatively large stiffness passes a route away from the guide plate 48 and led to the contacting portion of the take-in roller 46. In particular, with regard to a mail P having a large stiffness above a prescribed level passes on a path entirely not interfering the projecting portion 49 projecting from the guide plate 48 (refer to FIG. 5).

On the other hand, a mail P5 having a relatively small stiffness is folded at a relatively small curvature immediately after passing the end of the nip 37 and is directed to the stacking portion 40. Therefore, a mail P5 having a relatively small stiffness passes through a path close to the guide plate 48 and is lead to the contacting portion of the take-in roller 46.

In other words, a distance from the end of the nip 37 to the inclined plane 39 of the gate 38 that is switched to the second position, an angle of gradient of the inclined plane 39 that is set at the second position, length and shape of the gate 38 are so designed that a mail P having a small stiffness passes a route close to the guide plate 48 and a mail P having a large stiffness passes a route away from the guide plate 48.

Here, an effect to change the input course of the gate 38 according to stiffness of a mail P will be explained. When a mail is brought in contact with the inclined plane 39 of the gate 38 in the state clamped by the conveyer belts 33 and 35, this state is maintained at a gentle curvature when it has stiffness as shown in FIG. 6. However, when stiffness is small, a mail P is suddenly curved at a point near where it is clamped by the conveyer belts 33 and 35 and is brought in contact with the inclined plane 39 of the gate 38. As the rear end of a mail P without any supporting matter becomes straight, the direction pointed by the rear end becomes the input direction.

In this embodiment, the gate 38 is arranged so that the inclined plane 39 is formed to a point 22 mm away from the primary conveying path 34 at an angle 36° at a point 30 mm away from the clamping point of the conveyer belts 33 and 35 in the primary conveying path 34. As a result, it becomes possible to sufficiently switch the input course according to a different stiffness of a mail P.

A mail P5 having a relatively small stiffness passing a route relatively close to the guide plate 48 is fed toward the stacking portion 40 in the state contacting the guide plate 48 substantially. Then, the rear end of the mail P5 is fed into the contacting portion between the surface of a second mail P2 at the other end of the stacking direction in contact with the take-in roller 46 and the periphery surface. Thereafter, the take-in roller 46 rotates to contact the mail P5 and by the rotation of the take-in roller 46, the mail P5 is further taken in the stacking portion 40 along the mail P2 at the end. Then, the rear end of the mail P5 is bumped against the absorbing gel 43 of the rear wall 42 and the mail P5 is stopped and stacked in the stacking portion 40.

Thus, the rear end in the conveying direction of a mail P5 having a relatively small stiffness taken in along the guide plate 48 is separated from the guide plate 48 by the action of the projection portion 49. That is, a mail P5 having a small stiffness is liable to be kept closely fitted to the guide plate 48 and therefore, is separated from the guide plate 48 to make an entrance wide for a mail that is taken in next. Then the lower side of the mail P5 separated from the guide plate 48 is put on the spiral rotary cogh of the screw 51 and fed to a mail P2 at the end by the rotation of the screw 51. Thus, mails P that are taken in next can be stacked orderly.

On the contrary, when the guide plate 48 has no projection portion 49, the rear end of a mail P5 having a small stiffness in the conveying direction is closely contacted to the guide plate 48 and the rear end of a mail P5 is not put on the rotary cog of the screw 51. As a result, a mail that is taken in next is input between the mail kept closely fit to the guide plate 48 and a preceding mail, and a jamming is caused.

On the other hand, a mail P4 having a stiffness above a prescribed level among mails P4 having a relatively large stiffness and passing a path away from the guide plate 48 is taken into the stacking portion 40 without interfering the projection portion 49 that is projecting from the guide plate 48. Then, the rear end of the mail P4 in the conveying direction is led to the contacting portion of the take-in roller 46, taken in the stacking portion 40 and bumped against the absorbing gel 43 on the rear wall 41, and stopped there.

When the front end in the conveying direction of a mail P4 having a large stiffness is clamped by the take-in roller 46, its rear end in the conveying direction is biased toward a mail P2 at the already stacked end by the stiffness of the mail P4 itself. Then, the rear end of the mail P4 is put on the rotary cog of the screw 51 as it is and fed toward a mail P2 at the end.

Thus, plural mails P successively conveyed are taken in the stacking portion 40 orderly and housed in the stacked state. At this time, the backup plate 44 is slid in the arrow direction S depending on a stacking volume of mails P by a sliding mechanism (not shown).

Thus, according to the second embodiment, the conveying state of mails P is changed depending on stiffness of mails P, a mail P5 that has a small stiffness and is liable to generate the defective stacking, is taken in the stacking portion 40 through a conveying path near the guide plate 48, and the rear end of the mail P5 is separated from the guide plate 48 by the projection portion 49 projecting to the guide plate 48. As a result, it becomes possible to normally process a mail P4 having a relatively large stiffness and surely stack a mail P5 having a relatively small stiffness in the stacking portion 40.

By the way, in the above-mentioned type of collection apparatus 31, the take-in roller 46 for taking mails P in the stacking portion 40 and the screw 51 for feeding the rear end in the conveying direction of mails P in the stacking direction are generally rotated constantly. However, there was such a problem that when the take-in roller 46 was rotated constantly, a second mail P2 at the stacked end was constantly kept in contact with the take-in roller 36 and the surface of the mail P2 became dirty or was damaged. Further, when the screw 51 was rotated constantly, there was also a problem that a mail P2 at the end was contaminated or worn.

In the second embodiment, therefore, it is so designed that the take-in roller 46 and the screw 51 are driven and rotated by an AC motor and are stopped when a mail P is not conveyed.

Figure 10:
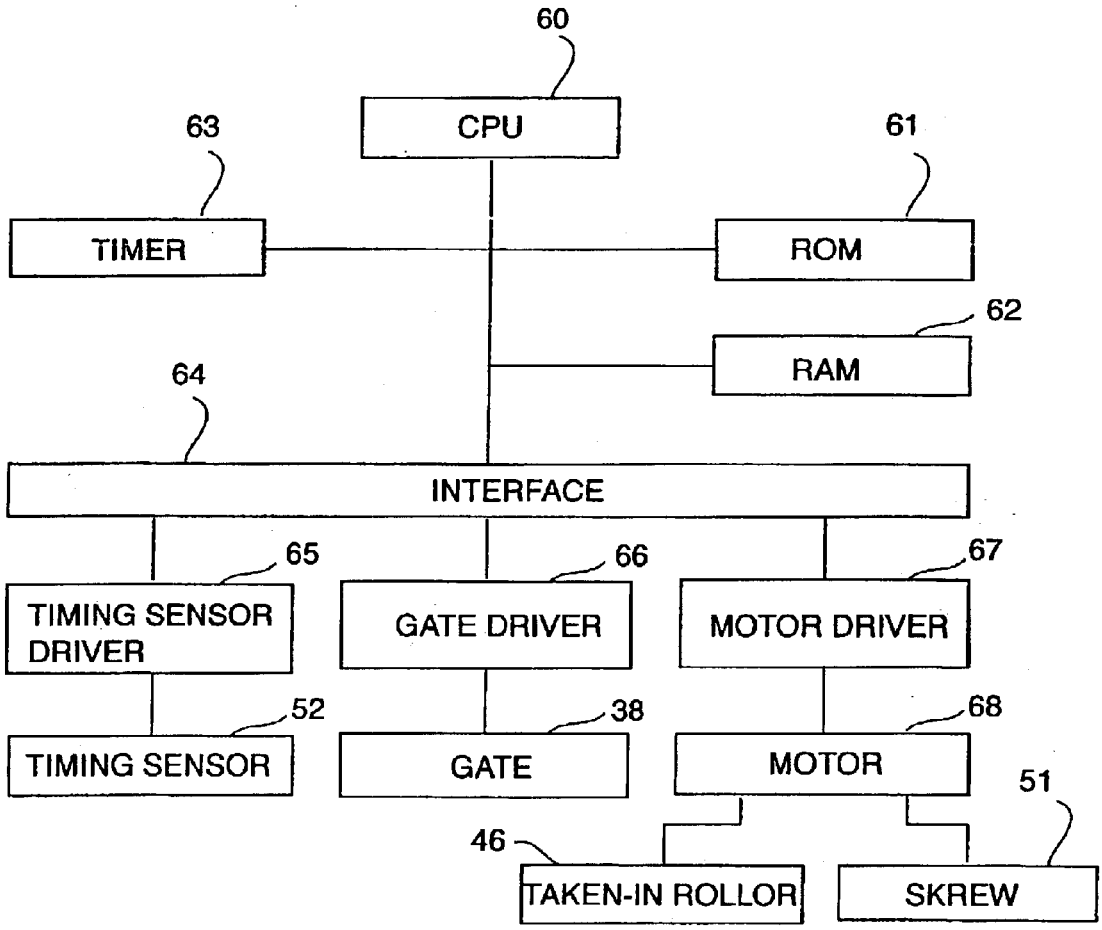
FIG. 10 is a block diagram for controlling the operation of the mail collection apparatus shown in FIG. 5.

FIG. 10 shows a block diagram for operating the collection apparatus 31. A CPU 60 controls the entire collection apparatus and is connected with an ROM 61 stores a program, a RAM 62 as a working area and a timer 63, respectively. Further, the CPU 60 is connected with a timing sensor driver 65, a gate driver 66 and a motor driver 66 through an interface 64, respectively. The timing sensor driver 66 is connected with a timing sensor 52. The gate driver 66 is connected with the gate 38 via a driving mechanism (not shown). The motor driver 67 is connected with the take-in roller 46 and the screw 51 via a motor 68.

Figure 8:
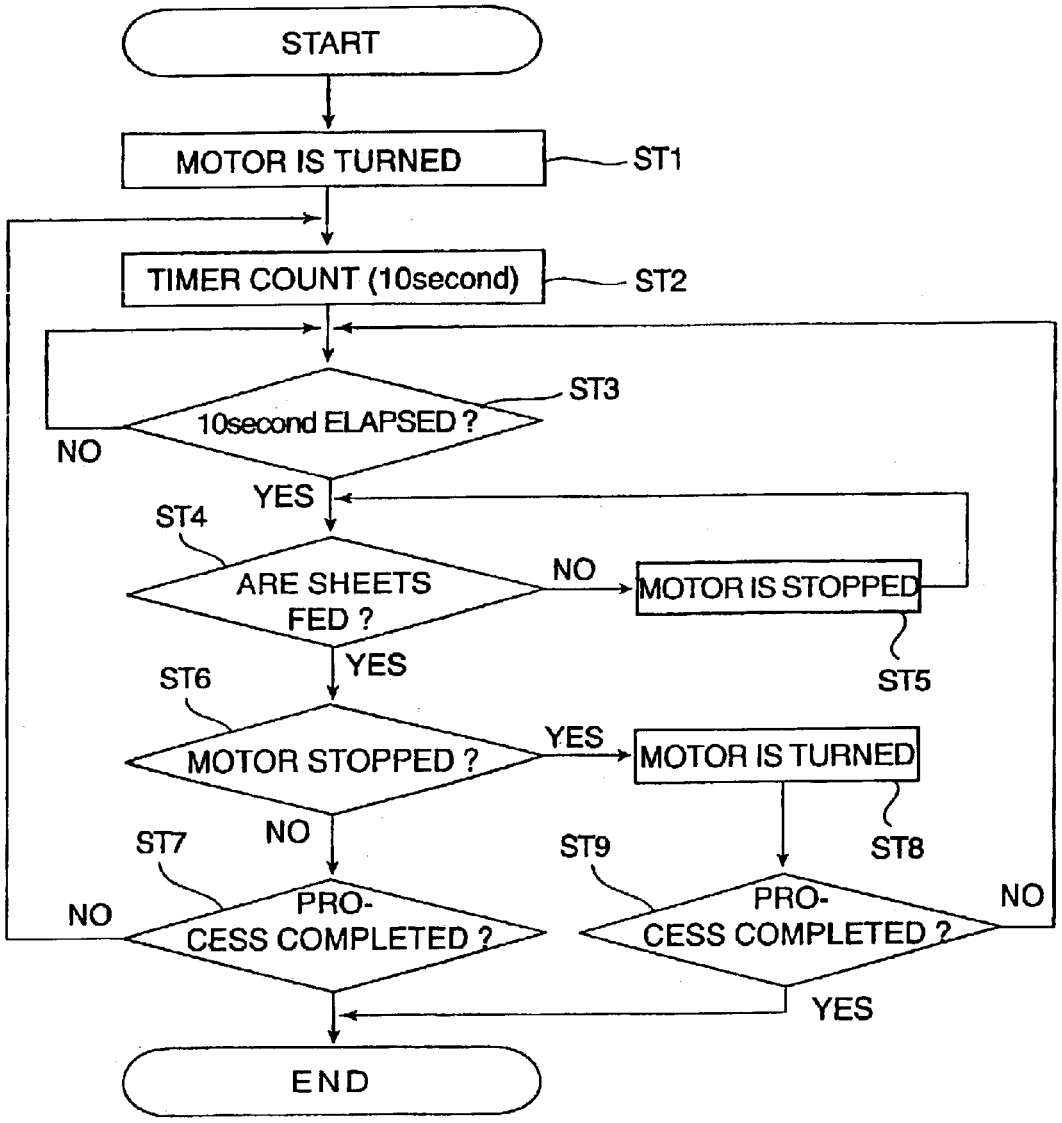
FIG. 8 is a flowchart for explaining the stopping control operation of a take-in roller and a screw.
Figure 9:
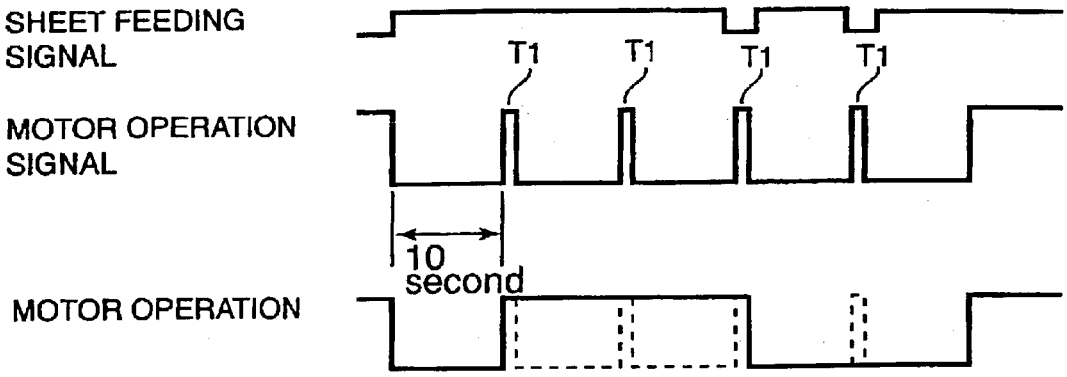
FIG. 9 is a timing chart for explaining the operation jointly with the flowchart shown in FIG. 8.

The stop control operation of the take-in roller 46 will be explained below referring to a flowchart shown in FIG. 8, a timing chart in FIG. 9 and the block diagram in FIG. 10.

First, the motor 68 is rotated by the operation of the motor driver 67 based on the control from the CPU 60 via the interface 64 and the take-in roller 46 and the screw 51 are rotated (Step 1). Then, a predetermined time interval (10 seconds in this embodiment) is counted by the timer 63 (Step 2) and a motor operation signal is generated every 10 seconds (FIG. 9; T1).

Then, at every 10 seconds (Step 3; YES), the CPU 60 judges whether a next mail is fed (Step 4). At this time, the CPU 60 judges the presence of a mail P based on a sheet feeding signal (FIG. 9) that is output via the timing sensor 52 provided in the primary conveying path 34.

When the CPU 60 judges that there is no mail P in Step 4 (Step 4; NO), the motor 68 is stopped via the motor driver 67 and the take-in roller 46 and the screw 51 are stopped to rotate(Step 5). Hereafter, returning to the process in Step 4, the presence of mails P is monitored by the CPU 60 via the timing sensor 52.

On the other hand, when the CPU 60 judges that there are mails P (Step 4; YES) in Step 4, the take-in roller 46 and the screw 51 are rotated under the condition that the motor 68 is not stopped (Step 6; NO) and the processing does not complete (Step 7; NO). Then, the operation is shifted to the processing in Step 2 and the counting by the timer 63 is newly started.

When the CPU 60 judges the presence of mails P via the timing sensor 22 (Step 4; YES) after stopping the motor 68 via the motor driver 67 in Step 5, the motor kept stopped is immediately rotated (Step 6: YES, STEP 8). Then, the operation returns to the processing in Step 3 under the condition that the processing operation does not complete (Step 9; NO).

As described above, a time of stacked second mail P2 for sliding and contacting the take-in roller 46 can be made short by stopping the take-in roller 46 stopped and the screw 51 when no mail P is fed and thus, a problem of contamination/worn of a mail P2 resulting from the slide contacting can be reduced.

FIG. 7 shows the collection state of mails P when plural mails P (collection volume; 500 mm) using the above-mentioned collection apparatus 31. Here, the status of mails P were examined when the conveying speed by the primary conveying path 34 was changed by varying the length of mails P in a range 140–260 mm and stiffness in a range 200–1500 mN. Further, the stiffness of mails P is a force [mN] required to bend mails P to an angle 20° by holding them at a space of 20 mm using a bending strength gauge. Further, the rotation of the take-in roller 46 was properly controlled as described above.

As a result of this experimental test, it was revealed that the posture of mails P stacked in the stacking portion 40 was generally favorable at the conveying speeds 3.8 m/s and 3.3 m/s. Further, with regard to the stacking posture, jam and skew of mails P were examined. In particular, with regard to jam of mails P, no jamming was generated at all on all lengths irrespective of stiffness of mails P. Further, contamination/work of mails P was not generated.

Further, in the above-mentioned second embodiment, the projection portion 49 projecting from the guide plate 48 was a separation portion for separating a mail P5 having a relatively small stiffness from the guide plate 48. However, not restricted to the projection portion 49, any means capable of satisfactorily separating the rear end of mails P from the guide plate 48 is usable.

Further, the present invention is not limited to the above-stated embodiment but can be variously modified without departing from the spirit and scope thereof. For example, in the above embodiment, a case of the stacking of mails is explained but the present invention is also applicable as an apparatus to convey valuable securities including banknotes, such sheets as ID cards at high-speeds and stack them.

As explained above, the sheet collection apparatus of the present invention has a structure and actions as described above and therefore, various kinds of sheets conveyed at relatively high-speeds can be stacked in a stacking portion certainly in a stable posture.

Further, the sheets collection apparatus of the present invention is capable of collecting any sheets irrespective of stiffness of sheets.

What is claimed is:

1. A sheet collection apparatus to handle first, second and third sheets conveyed in order at a first speed, comprising:

a bumping wall which an edge of the sheets bumps and which stops the sheets;

a stacking portion to collect the sheets stopped by the bumping wall;

a biasing member to compressively contact a surface of the first sheet collected in the stacking portion;

a take-in roller provided opposite to the biasing member, wherein the take-in roller rotates at a second speed that is slower than the first speed of the third sheet, sends the third sheet to the stacking portion along the second sheet already collected in the stacking portion, and makes the edge of the third sheet bump the bumping wall.

2. The sheet collection apparatus according to claim 1, wherein the second speed ranges from one third to two third of the first speed.

3. The sheet collection apparatus according to claim 1, wherein the first and second speeds V mm/sec and Vr mm/sec satisfy the following equation;

$$V>Vr\geq Lw\times V/(Lmin+G)$$

where Lw mm is a distance from the position where the take-in roller contacts the third sheet to the bumping wall, Lmin mm is a minimum length of the sheets measured along the conveying direction, and G mm is a gap defined between the sheets conveyed at the first speed.

4. The sheet collection apparatus according to claim 1, wherein the bumping wall includes a gel to absorb a shock caused by the edge of the sheets.

5. A sheet collection apparatus to handle first, second and third sheets conveyed in order at a first speed, comprising:

a bumping wall which an edge of the sheets bumps and which stops the sheets;

a stacking portion to collect the sheets stopped by the bumping wall;

a biasing member to compressively contact a surface of the first sheet collected in the stacking portion; and a take-in roller provided opposite to the biasing member, wherein the take-in roller rotates at a second speed that is slower than the first speed to reduce gradually a speed of the third sheet, contacts and sends the third sheet to the stacking portion along the second sheet already collected in the stacking portion, and makes the edge of the third sheet bump the bumping wall.

6. The sheet collection apparatus according to claim 5, wherein the take-in roller reduces the speed of the third sheet and stops after sending the third sheet to the bumping wall.

7. The sheet collection apparatus according to claim 5, wherein the second speed Vr mm/sec varies to satisfy the following equation:

$$\int_{O}^{Cmin} Vrdt \geq Lmin+G$$

where Cmin sec is a minimum conveying cycle of the sheet conveyed at the first speed, Lmin mm is a minimum length of the sheets measured along a conveying direction, and G mm is a gap defined between the sheets conveyed at the first speed.

8. The sheet collection apparatus according to claim 5, wherein the bumping wall includes a gel to absorb a shock caused by the edge of the sheets.

9. A sheet collection apparatus to handle first, second and third sheets conveyed in a standing position in order at a first speed, comprising:

a bumping wall which an edge of the sheets bumps and which stop the sheets;

a stacking portion including a substantially horizontal bottom plate to receive a lower edge of the sheets stopped by the bumping wall;

a biasing member to compressively contact a surface of the first sheet received by the stacking portion;

a take-in roller provided opposite to the biasing member, wherein the take-in roller rotates at a second speed that is slower than the first speed, sends the third sheet to the stacking portion along the second sheet already collected in the stacking portion, and makes the edge of the third sheet bump the bumping wall; and a moving mechanism to move the lower edge of the sheets to first and second directions which are opposite to each other.

10. The sheet collection apparatus according to claim 9, wherein the moving mechanism includes a toothed roller projected partially from the bottom plate to rotate in the first and second directions.

11. The sheet collection apparatus according to claim 9, wherein the toothed roller rotates in the first direction to move a lower edge of the sheets in the first direction when an upper edge of the sheets inclines to the first direction and rotates in the second direction to move a lower edge of the sheets in the second direction when the sheets collected have been more in amount than a predetermined value and to rotate otherwise in accordance with a moving direction of the sheets.

12. The sheet collection apparatus according to claim 9, wherein the bumping wall includes a gel member to absorb a shock caused by the sheets when the edge of the sheets bumps the bumping wall.

13. A sheet collection apparatus to handle first, second and third sheets conveyed in order at a first speed, comprising:

a bumping wall which an edge of the sheets bumps and which stops the sheets;

a stacking portion to collect the sheets stopped by the bumping wall;

a biasing member to compressively contact a surface of the first sheet collected in the stacking portion;

a take-in roller provided opposite to the biasing member, wherein the take-in roller rotates at a second speed that is slower than the first speed, sends the third sheet to the stacking portion along the second sheet already collected in the stacking portion, and makes the edge of the third sheet bump the bumping wall;

a guide plate to guide the third sheet between the take-in roller and the second sheet already collected in the stacking portion; and a separating portion to separate the third sheet guided along the guide plate from the guide plate.

14. The sheet collection apparatus according to claim 13, wherein the separating portion includes a projection portion provided at the guide plate.

15. The sheet collection apparatus according to claim 13, further comprising a regulator to align the third sheet separated from the guide plate by the separating portion with the second sheet already collected in the stacking portion.

16. The sheet collection apparatus according to claim 15, further comprising a central processor unit to disable the take-in roller and the regulator from operating when the third sheet is not provided thereto.

17. The sheet collection apparatus according to claim 13, further comprising a sensor to detect the first, second and third sheets at a cycle longer than a collection cycle of the sheets; and a central processor unit to judge in response to an output detected by the sensor whether the take-in roller is continuously enabled to operate.

18. A sheet collection apparatus comprising:

a conveyer to convey first, second and third sheets along a primary conveying path at a first speed;

a bumping wall provided out of the primary conveying path to receive an edge of the sheets conveyed by the conveyer and to stops the sheets from moving;

a stacking portion to collect the sheets stopped by the bumping wall;

a biasing member to compressively contact a surface of the first sheet collected in the stacking portion;

a take-in roller provided opposite to the biasing member, wherein the take-in roller rotates at a second speed that is slower than the first speed, sends the third sheet to the stacking portion along the second sheet already collected in the stacking portion, and makes the edge of the third sheet bump the bumping wall;

a conveying direction changer with an inclined plane defined at a predetermined angle at a place of the primary conveying path to change a conveying direction of the sheets from the conveying path to the stacking portion;

a guide plate substantially connected to the inclined plane of the conveying direction changer to guide the third sheet between the take-in roller and the second sheet already collected in the stacking portion; and a separating portion to separate the third sheet guided along the guide plate from the guide plate.

19. The sheet collection apparatus according to claim 18, wherein the conveying direction changer includes a gate to switch the conveying direction from a first position for the sheets to pass along the primary conveying path to a second position for the sheets to direct to the stacking portion.

20. The sheet collection apparatus according to claim 18, wherein the separating portion includes a projection portion projecting from the guide plate to the second sheet already collected in the stacking portion.

21. The sheet collection apparatus according to claim 20, wherein the inclined plane of the conveying direction changer is so inclined that the sheets having a small stiffness pass through a path close to the guide plate or that the sheets having a large stiffness pass through a path far from the guide plate.

22. The sheet collection apparatus according to claim 21, wherein the projection portion projects so as not to interfere the third sheets having larger stiffness than a predetermined stiffness value.

23. The sheet collection apparatus according to claim 18 further comprising a regulator to align the third sheet separated from the guide plate by the separating portion with the second sheet already collected in the stacking portion.

24. The sheet collection apparatus according to claim 23 further comprising a central processor unit to disable the take-in roller and the regulator from operating when the third sheet is not provided thereto.

* * * * *